US006317148B1

(12) United States Patent
Hayashi et al.

(10) Patent No.: US 6,317,148 B1
(45) Date of Patent: Nov. 13, 2001

(54) THERMAL TRANSFER RECORDING MEDIUM AND THERMAL TRANSFER RECORDING METHOD

(75) Inventors: Masafumi Hayashi; Shunichi Ebihara, both of Tokyo-To (JP)

(73) Assignee: Dai Nippon Printing Co., Ltd. (JP)

( * ) Notice: Subject to any disclaimer, the term of this patent is extended or adjusted under 35 U.S.C. 154(b) by 0 days.

(21) Appl. No.: 09/335,721

(22) Filed: Jun. 18, 1999

Related U.S. Application Data

(62) Division of application No. 08/841,406, filed on Apr. 30, 1997, now Pat. No. 5,953,037, which is a division of application No. 08/351,078, filed on Nov. 30, 1994, now Pat. No. 5,712,673.

(30) Foreign Application Priority Data

Dec. 1, 1993 (JP) ..... 5-325749
Apr. 21, 1994 (JP) ..... 6-104975

(51) Int. Cl.[7] ..... B41M 5/26; B41J 2/325
(52) U.S. Cl. ..... 347/172; 347/171; 347/217; 428/207
(58) Field of Search ..... 347/217, 221, 347/171, 172; 428/195, 207, 206

(56) References Cited

U.S. PATENT DOCUMENTS 5,712,673 1/1998 Hayashi et al. ..... 347/172

FOREIGN PATENT DOCUMENTS 62-013389 1/1987 (JP) .
62-181186 8/1987 (JP) .
63-315292 12/1988 (JP) .

*Primary Examiner*—Huan Tran
(74) *Attorney, Agent, or Firm*—Parkhurst & Wendel, LLP

(57) ABSTRACT

The invention relates to a thermal transfer sheet including a thermally transferable ink layer on one surface of a substrate film, wherein said ink layer contains a coloring agent, and a decoloring agent that prevents thermal color-developing paper from color development or makes the color, once developed thereby, invisible; a thermal transfer sheet including on one surface of a substrate film a first thermally transferable ink layer containing a decoloring agent that prevents thermal color-developing paper from color development or makes the color, once developed thereby, invisible, wherein at least one second thermal transfer ink layer is interposed between said ink layer and said substrate film; and a thermal transfer recording method that uses these thermal transfer sheets.

Also, the invention relates to a rimmed image wherein at least an area of thermal color-developing paper is solid-heated for color development, and an image is formed in said color-developed area with the edge being rimmed in whites or other color; and a method for forming a rimmed image.

8 Claims, 3 Drawing Sheets

THERMAL TRANSFER RECORDING MEDIUM AND THERMAL TRANSFER RECORDING METHOD

This is a Division of application Ser. No. 08/841,406 filed Apr. 30, 1997 which in turn is a division of U.S. Ser. No. 08/351,078 now U.S. Pat. No. 5,712,673.

BACKGROUND OF THE INVENTION

The first aspect of the present invention relates generally to a thermal transfer sheet and a multicolor thermal transfer recording method, and more particularly to a thermal transfer sheet that enables plain paper printing and multicolor recording when printing is carried out with thermal color-developing paper, a multicolor thermal transfer method, and a multicolor printed matter.

The second aspect of the present invention relates generally to an edged or rimmed image and a method of forming the same, and more specifically to an image that is formed with a hue different from that of the background in which the image is formed and is rimmed with white or other color and a method of forming the same.

So far, color output has been achieved by thermal color development, thermal transfer, ink-jet, electrophotography or other techniques. Among these, the ink-jet technique has recently enjoyed an increasing use for the reason that it can output color images more easily than would be possible with other techniques. With this technique, it is possible to output colors for paper of size A4 or so within a relatively short time. However, much time is now needed to output colors for paper of larger size, esp., size A1 or banners, and costly equipment is required as well. In addition, the obtained image has a problem in terms of water resistance and so is unsuitable for outdoor purposes. Electrophotography has some merits in that output time is short and an image of good-enough durability is obtainable although the principle of toner fixation takes part in this. However, this technique is not readily available because equipment is exspensive to buy and maintain.

On the other hand, the thermal color-developing recording technique using thermal color-developing paper and a thermal head is shorter in terms of output time than other techniques. In addition, the cost of equipment used for large color output is not much higher than that of equipment used with other techniques. The thermal transfer technique using a thermal transfer sheet and a thermal head, because of using a pigment type of coloring material, has the advantage of being capable of forming a color image excellent in durability such as light fastness, and accordingly can be used outdoors. This technique can output a color image at relatively low cost.

For the thermal transfer printing technique, a thermal transfer sheet has been used, which includes a thermally transferable ink layer (hereinafter called simply an ink layer) formed on one surface of a substrate film. This conventional thermal transfer sheet is prepared by coating an ink layer comprising a mixture of wax with a pigment, dye or other coloring agent on a substrate film such as paper of 10 $\mu$m to 25 $\mu$m in thickness, for instance, condenser or paraffin paper, or a plastic film of 2 $\mu$m to 25 $\mu$m in thickness, for instance, a polyester or cellophane film.

In general, the thermal color-developing technique has wide application, because it can output descriptions or patterns at much lower cost as compared with the thermal transfer technique; in other words, the unit cost of printing becomes low as output size becomes large. In addition, several approaches have been proposed to multicolor printing used in combination with this thermal color-developing technique.

The thermal color-developing method is particularly excellent in expressing a single color, but various means are needed for recording a multicolor image, e.g., a two- or three-image.

As disclosed in JP-B 49-69 as an example, there has been proposed a multicolor printing method in which an applied energy is varied by use of a multilayer structure comprising color-developing layers having varying melting points. With this method, however, it is not always easy to form a bright color because the layer having a higher melting point develops an unclear color.

One means for making multicolor recording using thermal color-developing paper is to provide a double- or triple-layer structure for color development on the thermal color-developing paper. For instance, JP-A 57-178791 discloses the provision of two color-developing layers that differ in color-developing temperature and coloration, between which there is an intermediate layer containing a decoloring agent that makes the color developed by one of the color-developing layers invisible. By varying the printing temperature it is thus possible to make printing in two different colors.

On the other hand, a method of using thermal color-developing paper as the so-called cooperative member wherein an ink layer is transferred from a thermal transfer sheet to the color-developing surface thereof while the hue of the ink layer of the thermal transfer sheet is differently combined with the hue of the color developed by the thermal color-developing paper, thereby making it easy to form an image of two or more colors, is proposed in JP-B 3-25355 and JP-B 3-32476. Another method comprising a combination of transfer technique with color-developing paper such as one mentioned above has been proposed as well (JP-A 59-42996 and JP-A 56-157395), but this has a similar problem as mentioned above. In addition, JP-A 63-315292 discloses use of thermally color-developed paper. Only the required portion of the paper is then made invisible by use of a decoloring agent present in a thermal transfer sheet for the so-called white printing. This method is used as a presentation tool for OHP and other purposes.

In the case of the thermal paper disclosed in JP-A 57-178791 that is designed to develop two colors, however, some limitation is placed on the combination of the colors to be printed, once the colors to be developed have been determined. In other words, although there is no problem in terms of two-color recording, practical difficulty is involved in four-, five- or more-color recording. In the case of the method disclosed in JP-B 3-32476 wherein two-color recording is achieved by the combination of low-temperature transfer with high-temperature color development, on the other hand, it is impossible to achieve multicolor recording in bright, e.g., blue or red, colors, because at high temperature the image is inevitably recorded in a mixture of the color of the ink layer with the color developed by the color-developing paper. In the case of the method disclosed in JP-B 3-25355 wherein two-color recording is achieved by the combination of low-temperature color development with high-temperature transfer to the contrary, color mixing during high-temperature transfer unavoidably occurs, as mentioned just above. Moreover, the method disclosed in JP-A 63-315292 is to prepare the so-called white characters or logos and so lends itself to OHP image formation, but cannot form any multicolor image.

One possible approach to solving such problems is to incorporate white or other pigment of high hiding power in the ink layer or in the outer subordinate layer thereof (see JP-A 2-214694). However, this makes the color tone of the ink layer light or pastel; so making clear color printing impossible. Moreover, some considerable printing energy. is needed because the hiding layer deprives heat of a thermal head.

Therefore, the first object of the present invention is to provide a thermal transfer sheet that enables plain paper to be printed with thermal energy used so far in the art and clear and versatile multicolor recording to be made even on thermal color-developing paper, a multicolor recording method, and a printed matter.

Heretofore, so-called edged or rimmed images have been available for various images inclusive of characters or logos, or for ad-posters, and illustrated books for infants and juveniles of the lower classes. One typical rimmed image is shown in FIG. 6 wherein a white area 62 that is similar in shape to, and somewhat larger in size than, a desired image is formed in a colored background 61 on thermal color-developing paper 60, and an image 63 that is similar in shape to, and somewhat smaller than, the area 62 is formed therein by printing.

The above rimmed image is usually formed as by offset printing, gravure printing, and screen printing. No coste-effectiveness problem arises in mass-printing, although at least two plates are needed and printing operation is troublesome. However, these printing techniques incur some considerable expense when making a small amount of prints such as ad-posters and propaganda leaflets distributed as by stores, and discount tags; that is, they must manually be made. However, it is very difficult to manually make dozens of the same image.

Therefore, the second object of the present invention is to provide a means for making aesthetically excellent rimmed images in a very simple way.

DISCLOSURE OF THE INVENTION

First Aspect of the Invention

The first object of the invention mentioned above is achieved by the following aspect of the invention.

Specifically, the present invention provides a thermal transfer sheet including a thermally transferable ink layer on one surface of a substrate film, wherein said ink layer contains a coloring agent, and a decoloring agent that prevents thermal color-developing paper from color development or makes the color, once developed thereby, invisible; a thermal transfer sheet including on one surface of a substrate film a first thermally transferable ink layer containing a decoloring agent that prevents thermal color-developing paper from color development or makes the color, once developed thereby, invisible, wherein at least one second thermal transfer ink layer is interposed between said ink layer and said substrate film; thermal transfer recording methods that use these thermal transfer sheets; and multicolor printed matters obtained by such methods.

With the ink layer printed on thermal color-developing paper, the decoloring agent present in the ink layer or in the transfer layer prevents the thermal color-developing paper from color development due to printing heat or makes the color, once developed thereby, invisible. Even when thermal transfer printing is made on the area of the thermal color-developing paper that has been allowed to develop a color for printing, the color-developed area is made invisible by the action of the decoloring agent. Consequently, clear and versatile multicolor recording can be made with no change in the hue of the transferred ink layer.

Second Aspect of the Invention

The second object of the invention mentioned above is achieved by the following second aspect of the invention.

Specifically, the invention relates to a rimmed image wherein at least an area of thermal color-developing paper is solid-heated for color development, and an image is formed in said color-developed area with the edge being rimmed in white or other color; and a method for forming a rimmed image.

For instance, when the decoloring agent-containing hot-melt ink layer is printed on thermal color-developing paper, the decoloring agent present in or on the ink layer prevents the thermal color-developing paper from color development due to printing heat or makes the color, once developed thereby, invisible. Even when thermal transfer printing is made on the area of the paper that has been printed by color development, the decoloring agent makes the color-developed area invisible. When a decoloring agent less compatible with the binder of the hot-melt ink layer is used as the decoloring agent, it diffuses itself over an area of the paper that is located in the vicinity of the transferred ink image, at which the thermal color-developing paper is prevented from color development (or otherwise makes the color, once developed, invisible).

Consequently, the white or colored edge of the ink image defines a rimmed area. Thus, a narrow white or colored area is defined between the color-developed and ink image areas on the thermal color-developing paper, so imparting greatly aesthetic or eye-catching appearance to the resulting image.

BEST MODE FOR CARRYING OUT THE INVENTION

The present invention will now be explained at great length with reference to the preferable embodiments.

First Aspect of the Invention

Several preferable embodiments of the thermal transfer sheet according to the present invention are shown in FIG. 1.

Figure 1A:
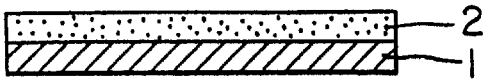
FIGS. 1B, 1C, 1D, 1E, 1F, 1G and 1H are sectional schematics of illustrative embodiments of the thermal transfer sheet according to the present invention.
Figure 1B:
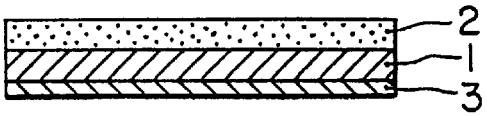
Figure 1C:
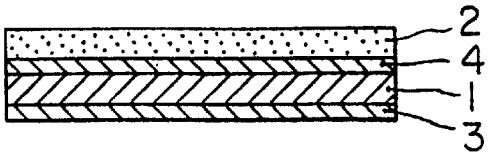

In one embodiment of the thermal transfer sheet shown in FIG. 1A, an ink layer 2 containing both a coloring agent and a decoloring agent is formed on a substrate film 1. In the embodiment shown in FIG. 1B, the substrate film used in the FIG. 1A embodiment is provided on the opposite side with a slip layer 3 in view of heat resistance and running stability with respect to a thermal head. In the embodiment shown in FIG. 1C that is a modification of the FIG. 1B embodiment, a mat layer 4 is additionally interposed between the substrate film 1 and the ink layer 2. In the embodiment shown in FIG. 1D the substrate film 1 includes a first ink layer 5 and a second ink layer 6 thereon. In the embodiment shown in FIG. 1E that is a modification of the FIG. 1D embodiment, a slip layer 3 and a mat layer 4 are additionally provided. In the embodiment shown in FIG. 1F that is a modification of the FIG. 1A embodiment, there is additionally provided a protective layer 7 for preventing the strike through of the ink layer 2. In the embodiment shown in FIG. 1G that is a modification of the FIG. 1C embodiment, a protective layer 6 is additionally provided. In the embodiment shown in FIG. 1H that is a modification of the FIG. 1E embodiment, an additional protective layer 7 is provided. It is here to be noted that these embodiments are illustrated by way of example but not by way of limitation.

No particular limitation is imposed on the substrate film used for the thermal transfer sheet of the present invention; that is, the same substrate film as used for conventional thermal transfer sheets may immediately be used. Of course, other films may be used as well.

Preferable examples of the substrate film are plastic films such as polyester, polypropylene, cellophane, polycarbonate, cellulose acetate, polyethylene, polyvinyl chloride, polystyrene, nylon, polyimide, polyvinylidene chloride, polyvinyl alcohol, fluorocarbon resin, chlorinated rubber and ionomer films, paper films such as condenser and paraffin paper films, unwoven fabric films, and woven fabric films, which may be used alone or in combination with two or more.

Substrate film thickness may preferably range from 2 $\mu$m to 25 $\mu$m, although it may be varied depending on the material of which the film is formed and the strength and heat conductivity required for the film.

The ink layer formed on the above substrate film comprises at least one of achromatizing agent, coloring agent and vehicle components, and may additionally contain various additives, if required.

The coloring material used herein may be organic or inorganic pigments or dyes, among which preference is given to a pigment or dye that has satisfactory recording characteristics. For instance, it is preferable to use a pigment or dye that is of sufficient coloring density and is well resistant to discoloration and fading due to light, heat, temperature, etc.

It goes without saying that carbon black is preferable for monochromatic or black printing. For other hues chromatic coloring materials of cyan, magenta, yellow or other colors may be used. It is generally preferable that these coloring materials account for about 3% by weight to about 70% by weight of the ink layer.

For the vehicle, waxes, drying oil, resins, mineral oil, cellulose, and rubber derivatives may be used alone or in admixture.

Tropical waxes are microcrystalline wax, carnauba wax, and paraffin wax. Besides, use may be made of various waxes such as Fischer-Tropsch wax, low-molecular-weight polyethylene waxes, Japan wax, beeswax, spermaceti, wool wax, shellac wax, candelilla wax, petrolatum, polyester wax, partially modified wax, fatty acid ester, and fatty amide. For the resins, use may be made of various thermoplastic resins known in the art, for instance, ethylene resins, acrylic resins, polyester resins, styrene-butadiene copolymers, and acrylonitrile-butadiene copolymers, which may be used alone or in admixture to improve the adhesion of the ink layer to various recording papers such as thermal color developing paper, plain paper, and synthetic paper.

The ink layer may be formed on the substrate film by hot-melt coating or many other means inclusive of hot-lacquer coating, gravure coating, gravure reverse coating, roll coating, and knife coating. Ink layer thickness may be in the range of 0.5 $\mu$m to 10 $\mu$m, preferably 1 $\mu$m to 5 $\mu$m as usual.

According to one embodiment of the present invention, a decoloring agent is incorporated in the ink layer when forming the ink layer. The decoloring agent is a reagent that junctions to prevent leuco and other dyes contained in thermal color-developing paper from color development due to thermally imparted protons or make the colors produced by the leuco and other dyes invisible. Although varying depending on the type of thermal color developer used, it is generally preferable to use thermoplastic polyether, polyethylene and polypropylene glycols and their deriviatives, alcohols such as stearyl alcohol, plasticizers such as dicyclohexyl phthalate, diethylhexyl phthalate and di(2-ethylhexyl) adipate, supercoolants such as polycaprolactone, polyester, acetamide, stearoamide, organic ammonium salts, organic amine, urea/thiourea and their derivatives, thiazoles, pyrroles, pyrimidines, piperazines, guanidines, indoles, imidazoles, imidazolines, triazoles, morpholines, piperidines, amidines, formamidines, pyridines, and olefin waxes, all being known decoloring agents and referred to by way of example alone.

The decoloring agent mentioned above has preferably a melting point of 40° C. to 100° C. as measured upon heated by the DSC method (at a heating rate of 7.5° C./min). A thermal transfer sheet obtained by use of a decoloring agent that is liquid at normal temperature is poor in storage stability, while a thermal transfer sheet obtained by use of a decoloring agent having a melting point higher than 100° C. fails to obtain sufficient printability and decoloring effects with ordinary printing energy. However, even a decoloring agent that is liquid at normal temperature, if encapsulated with a polymeric material having a suitable melting point, may be used as the decoloring agent in the present invention. In order that the decoloring agent is used as an ink layer material, it is preferable to have a melting viscosity of up to 1,500 cps at 100° C. With material having a melting viscosity exceeding 1,500 cps at 100° C., it is impossible to obtain sufficient decoloring effects, because the diffusion of the decoloring agent into thermal color-developing paper is limited upon thermal transfer printing.

If these decoloring agents have a suitable melting point and melting viscosity, then they may be independently used as the vehicle for the ink layer. However, when various fastness factors such as film strength are low, they are preferably used in combination with other binder, for instance, the waxes or resins mentioned above. According to the thermal transfer sheet of the present invention, it is also possible to improve post-printing fastness by the provision of another or the second ink layer. It is here to be understood that the second ink layer serves another purpose. For instance, if the second ink layer is mainly composed of waxes, not only does it contribute to an improvement in fastness, but it also serves as a release layer that improves releasability in printing.

If the second ink layer is made up of thermoplastic resins such as the above waxes, ethylene resins, acrylic resins, or polyester resins, then cohesive power can be imparted thereto.

In the present invention, the second ink layer is also allowed to serve as a coloring layer by addition of a coloring material. The second ink layer, when containing the coloring material plus a decoloring agent, makes the decoloring effect much better as compared with the case where the decoloring agent is added to the first ink layer alone. Thus, not only does the second ink layer perform a singles function depending on the desired purpose, but it can also perform a plurality of functions when used in combination with suitable materials each having its own function. When the desired purposes are not achieved even by use of the second ink layer, additional subordinate layer or layers may be added thereto to form a multilayer structure, if required.

The decoloring agent may generally be incorporated in an amount of at least 0.5 g/m$^2$ per m$^2$ of ink layer, although the content of the decoloring agent needed for the thermal transfer sheet of the present invention varies depending on the decoloring effect demanded and the amount of the color-developing dye contained in thermal color-developing paper. The thickness of the first and second ink layers is not particularly critical with the proviso that they contain the decoloring agents in the amount defined above.

Among the decoloring agents mentioned above, compounds having an ether bond in their molecule are particularly effective for preventing the color development of thermal color-developing paper or decoloring such paper. For instance, mention is made of polyethylene glycol or its derivative, polypropylene glycol or its derivative, polyglycerine or its derivative, aliphatic ethers, aromatic ethers, and cyclic ethers.

Among these, polyethylene glycol and its derivative, and polypropylene glycol and its derivative are particularly preferred. In view of the melting point, melting viscosity, solidifying characteristics and other factors needed for decoloring agents, the above-compounds should have a weight-average molecular weight of up to 7,000. preferably 1,000 to 5,000. A compound having a weight-average molecular weight less than 1,000 is unpreferable for decoloring purposes, because it is liquid and so must be encapsulated for use. A compound having a weight-average molecular weight higher than 7,000 is again unpreferable for decoloring purposes because, as is the case with melting viscosity, the infiltration of the decoloring agent into thermal color-developing paper becomes low, failing to achieve sufficient decoloring effects. In general, polyethylene glycol shows a high affinity for water; in some cases, a problem arises in terms of the storability of the obtained thermal transfer sheet when it is stored under high humidity conditions. In such cases, it is preferable to use polyethylene glycol with at least one of the terminal hydroxyl groups thereof being etherified or esterified with an alcohol, an organic acid, or a monomer, oligomer or polymer containing a carboxyl group. This ensures that the obtained thermal transfer sheet is improved in terms of storage stability.

Another possible approach to improving storability in surroundings is to incorporate fillers in the ink layer or layers or, in the alternative, provide a protective layer on the ink layer or layers. For the fillers incorporated into the ink layers, both organic and inorganic fillers may be used without restriction. However, preference is given to using organic fillers exemplified by ethylene-vinyl acetale copolymers, polyethylene, ionomer and polystyrene, and inorganic fillers represented by calcium carbonate, silica, kaolin and titanium oxide. Preferably, filler particle size is larger than ink layer thickness, because the pressure applied on the ink layer is absorbed by the filler, so that the blocking resistance of the thermal transfer sheet can be improved. When filler particle size is smaller than ink layer thickness, however, the above blocking-resistant effect is not available because the filler is buried in the ink layer.

It is here desired that the number of filler particles contained in the ink layer or exposed to the surface of the ink layer in which they are incorporated be in the range of about 500 to about 100,000/mm$^2$. At less than 500 no sufficient storability is available, whereas at more than 100,000° the transferability of the ink layer or the decoloring effect on the ink layer is so adversely affected. When the protective layer is provided on the ink layer, on the other hand, it may be made up of the waxes mentioned above, for instance, carnauba, paraffin, microcrystalline and polyethylene waxes, or resins such as silicone-modified acrylstyrene-butadiene rubber and polyester acrylolefin resins, which may be used alone or in suitable admixture. With these mixed with the fillers mentioned above, storability can be much more improved on the same principle as is the case with the incorporation of these in the ink layer.

Polyethylene glycols having a suitable melting point and melting viscosity may independently be used as the binder for the ink layer. However, since the polyethylene glycols themselves are low in terms of various fastness factors such as film strength, it is preferable to use them in combination with other binders, for instance, the waxes and thermoplastic resins such as ethylene resins, styrene-butadiene copolymers, acrylonitrile-butadiene copolymers and acrylic resins, all already mentioned.

In ink preparation, about 10 parts by weight to about 500 parts by weight of these decoloring agents may be mixed with 100 parts by weight of the wax or other binder. In the alternative, they may be incorporated in or on the ink layer in an amount of at least 0.5 g/m$^2$.

Figure 1D:
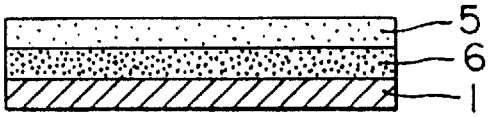
Figure 1E:
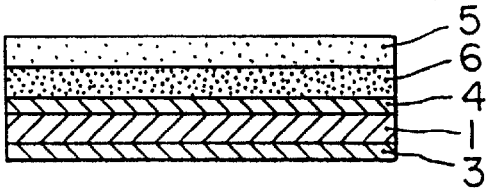
Figure 1F:
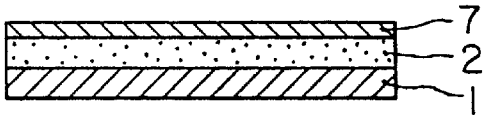
Figure 1G:
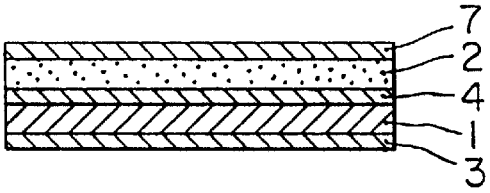
Figure 1H:
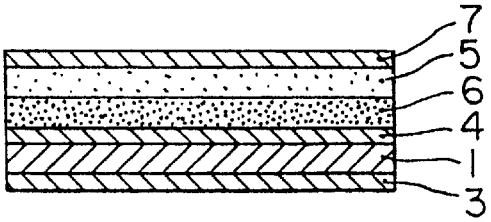

Reference will now be made to the thermal transfer sheet of the present invention which has a layer structure as shown in FIG. 1D. On the surface of the second ink layer 6 of the thermal transfer sheet prepared as conventional there is provided a first ink layer 5 that is obtained by coating the decoloring agent alone or together with such wax as mentioned above, when it is solid. In this case, no particular limitation is on the respective thickness of the first and second ink layers. To be sufficiently effective, however, it is preferable that the second ink layer is 0.01 $\mu$m to 5.0 $\mu$m, preferably 0.1 $\mu$m to 1.0 $\mu$m in thickness while the first ink layer is about 0.1 $\mu$m to about 10 $\mu$m, preferably 0.5 $\mu$m to 3.0 $\mu$m in thickness.

In preparing such ink layers as mentioned above, a decoloring layer of about 0.1 $\mu$m to about 10 $\mu$m in thickness may be interposed between the substrate film surfaces and the ink layer, so that the printed image can be decolored. A release layer comprising waxes or thermoplastic resins may also be pre-formed on the substrate film surface or the decoloring layer surface, so that it can serve as a surface protecting layer for the transferred image upon transfer. The release layer may be formed by suitable coating techniques such as hot-melt coating, hot-lacquer coating, emulsion coating, gravure coating, gravure reverse coating, and roll coating. In general, such a release layer is about 0.1 $\mu$m to about 5.0 $\mu$m in thickness.

As shown in FIG. 2, the thermal transfer method of the present invention is characterized in that while a thermal transfer sheet 8 of the present invention is superposed on thermal color-developing paper 9, heat is applied to the back side of the thermal transfer sheet by means of a thermal head 10.

Figure 2A:
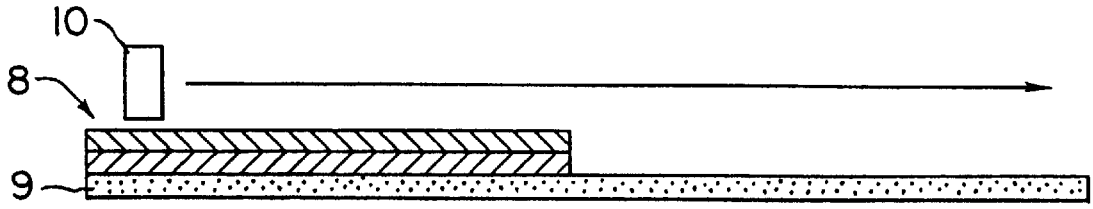
FIGS. 2A and 2B are sectional schematics of the recording process of the thermal transfer method according to the present invention.
Figure 2B:
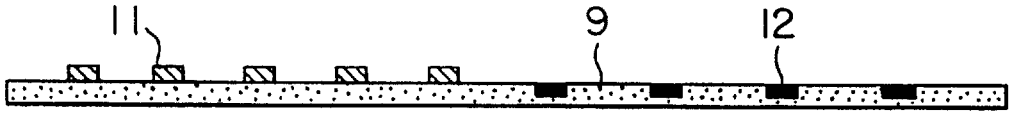

Referring now to FIG. 2A, the thermal transfer sheet 8 of thus present invention (the hue of the ink layer is red) is placed on a part of the surface of the thermal color-developing paper 9 that develops a black color as an example. Then, heat is applied to the back side of the sheet 8 through the thermal head 10, followed by release of the thermal transfer sheet. As can be seen from FIG. 2B, portions of the paper with the thermal transfer sheet present thereon are printed at 11 in red. It is found that since the heated portions of the paper 9 do not develop any black color, the transferred ink layers 11 show a clear red color. Here reference numeral 12 stands for color-developed portions of the paper.

Even when the thermal transfer sheet is placed on a part of the surface of the thermal color-developing paper precolored in black for heat transfer, the paper is printed in clear red, because the black color is not developed by the decoloring effect of the decoloring agent in the. ink layer of the thermal transfer sheet. For such printing, the thermal energy and printing pressure applied to the thermal head may be about 0.2 mJ/dot and about 2 kg/line (with the line width being A4 width) that have often been used for conventional line type head printing. Even with such energy and pressure, it is possible to achieve sufficient effects on decoloring thermal color-developing paper in other words, it is preferable that both thermal transfer and thermal color development occur under basically identical conditions, if troublesome control and other operation of the printer are taken into consideration. In some cases, however, the printing pressure and applied energy may be varied. To enhance the decoloring effects, it is desired that the energy and pressure be about 0.4 mJ/dot and about 4 kg/line, respectively.

The thermal color-developing paper used in the present invention is in itself known in the art; every type of known thermal color-developing paper may be used as the cooperative member in the present invention.

The thermal color-developing paper includes on the surface of its substrate paper a color-developing layer containing a leuco dye that develops a color by an acid and a solid acid serving as a developer. Such a color-developing layer may be divided into two subordinate layers one containing a dye and the other a developer or, in the alternative, may contain both a dye and a developer. Still alternatively, the dye and developer may each be encapsulated with a thermally destructible shell material for mulch more improved stability. In general, phenols are much used as the developer for thermal color-developing paper. In the present invention, too, it is preferable to use bisphenol or its derivative, especially bisphenol A. By use of the thermal transfer sheet of the present invention in combination with such thermal color-developing paper it is thus possible to achieve good decoloring effects.

The thermal transfer sheet of the present invention mentioned above and such conventional thermal color-developing paper may be used either separately or in a combined form wherein the ink layer surface of the sheet is tentatively bonded to the color-developing surface of the paper. They may also be used in a ribbon form accommodating to the mechanism of the printing machine used. The ribbon form of thermal transfer sheet may be provided with a lead tape or end mark as well.

Some illustrative embodiments of the multicolor printing method according to the present invention will now be explained.

Figure 3:
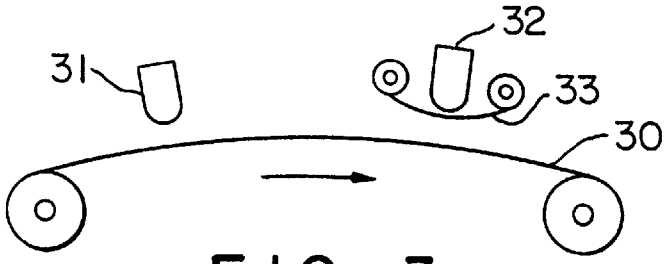
FIGS. 3, 4 and 5 are illustrative schematics of processes for carrying out the thermal transfer method according to the present invention.

FIG. 3 illustrates one embodiment where a plurality of thermal heads (for color-developing paper and transfer purposes) are used as printing means. In the arrangement shown in FIG. 3, thermal color-developing paper 30 is fed through a thermal printer, while a thermal head 31 for thermal color development purposes is operated. Subsequently, a decoloring agent-containing thermal transfer sheet 33 is transferred to the paper 30 with the use of a thermal head 32 for thermal transfer purposes to form a is given image while color development is controlled with decoloring. It is here to be understood that the recording order mentioned above may be reversed. It is also to be understood that a plurality of thermal heads 32 for thermal transfer purposes are located in the feeding direction for multicolor printing.

Figure 4:
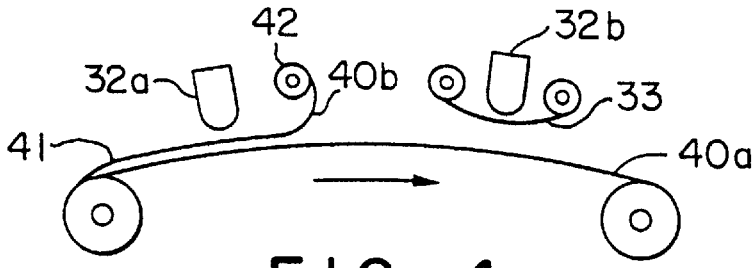

FIG. 4 illustrates one embodiment where there is used a combined ribbon 41 of plain paper 40*a* and thermal transfer sheet 40*b*. First, the combined ribbon 41 is fed for thermal transfer printing with a thermal head 32*a* for thermal transfer purposes while the thermal transfer sheet 40*b* is wound round a ribbon take-up portion 42. Subsequently, the decoloring agent-containing thermal transfer sheet 33 is used for thermal transfer printing with a thermal head 32*b* for thermal transfer purposes. In this embodiment, too, it is understood that a plurality of thermal heads may be located after the ribbon take-up portion for achieving multicolor printing.

Apart from the embodiments mentioned above, thermal printing may also be achieved by using a single thermal head for both color development and thermal transfer purposes. To make multicolor printing recording on heat-sensitive paper using this method, the heat-sensitive paper is first printed (locally or all over the surface). Following this, a cassette having a decoloring agent-containing thermal transfer sheet is automatically or manually manipulated for local or full printing. In this case, sensor means may be located at a given position of the thermal paper, because it is required to feed the heat-sensitive paper back to a predetermined position after the first printing.

Figure 5:
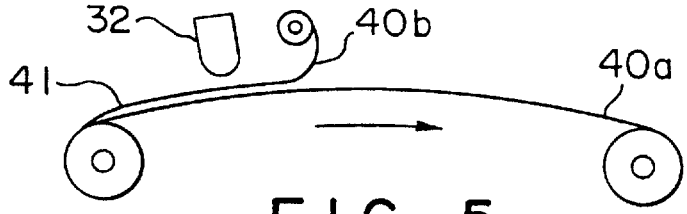

FIG. 5 illustrates one embodiment wherein a single thermal head is used for multicolor printing on plain paper. As is the case with the FIG. 4 embodiment, a combined ribbon is used. In this embodiment, automatic printing is achieved by the following steps.

a) A combined ribbon 41 is printed with a thermal head 32.

b) A ribbon 40*b* is wound up during printing.

c) A thermal transfer sheet is removed after the completion of given printing.

d) Plain paper 40*a* is rewound, followed by automatic loading of a cassette having a decoloring material-containing thermal transfer sheet.

e) The second information is printed with the thermal head 32.

Manual printing is achieved by the following steps.

a) The combined ribbon is printed with the thermal head 32.

b) After printing, the ribbon 40*b* is removed.

c) Plain paper 40*a* is rewound for re-positioning for printing.

d) A cassette having a decoloring agent-containing thermal transfer sheet is manually loaded in place.

e) The second information is printed with the thermal head 32.

In the embodiments shown in FIGS. 3–5, it is understood that paper can be used not only in rolled form but in sheet form as well. The present invention may find application for magnifying printers, large printers, plotters, and so on. Printed members obtained by the present invention may be used in the form of displays such as posters, notice boards, banners and hanging screens as well as for POP (e.g., publicity and leaflets) and image representation purposes.

Second Aspect of the Invention

The second aspect of the present invention will now be explained in more detail with reference to some preferable embodiments.

Figure 6:
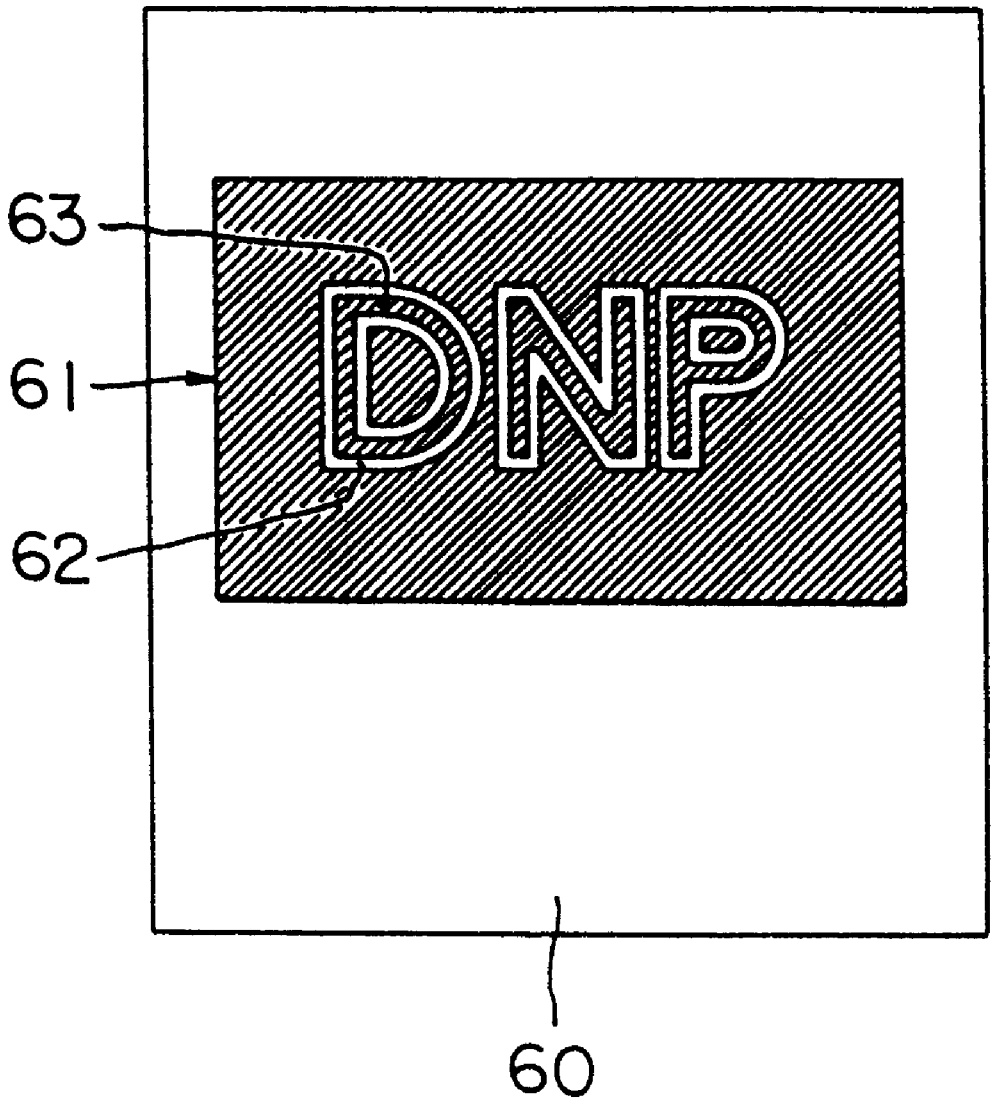
FIG. 6 is a plan schematic of one embodiment of the rimmed image according to the present invention.

In one embodiment of the edged image according to the present invention, as shown in FIG. 6, a white area 62 that is similar in shape to, and somewhat larger in size than, a desired image 63 is formed in a color-developing area 61 on thermal color-developing paper 60; in the white area 62 there is formed the image 63 that is similar in shape to, and somewhat smaller in size than, that white area 62.

The thermal color-developing paper used in the present invention is in itself known in the art; every type of known thermal color-developing paper may be used in the present invention.

The thermal color-developing paper includes on the surface of its substrate paper a color-developing layer containing a leuco dye that has a lactone structure developing a color by an acid and a solid acid serving as a developer. Such a color-developing layer may be divided into two subordinate layers one containing a dye and the other a developer or, in the alternative, may contain both a dye and a developer which are combined together through a binder. Still alternatively, the dye and/or developer may be encapsulated with thermally destructible shell materials for much more improved stability. In general, phenols are much used as the developer for thermal color-developing paper. In the present invention, too, it is preferable to use bisphenol or its derivative, especially bisphenol A.

In the present invention, the thermal color-developing paper mentioned above is allowed to develop a color before or after, or simultaneously with, image formation. Some methods of forming images will now be explained.

(1) Heat is applied to at least an area of thermal color-developing paper to develop a color all over the area. Then, mat ink is applied to the thus color-developed area to form a white image area, on which there is formed a colored image that is similar in shape to, and smaller in size than, that white image area.

An this method, an ordinary thermal transfer printer having a thermal head is used to apply heat to a desired area of thermal color-developing paper, thereby developing a color all over that area. Then, mat ink is transferred from a thermal transfer sheet including a decoloring agent-containing ink layer to the colored area to form a white area. Finally, a thermal transfer sheet including a coloring ink layer of a desired color tone is used to form a desired image in the white area mentioned above. These operations are all feasible with one printer.

(2) Mat ink is applied to at least an area of thermal color-developing paper to form a white latent image. In the white latent image area there is then formed a colored image that is similar in shape to, and smaller in size than, the image area. Finally, heat is applied to the image-containing area of the thermal color-developing paper to develop a color all over that area.

In this method, the same thermal transfer printer as used in (1) is used to transfer decoloring ink from a thermal transfer sheet including a decoloring agent-containing ink layer to the thermal color-developing paper to form a white latent image area (that will never develop a color even upon heating). Then, a thermal transfer sheet including a coloring ink layer of a desired color tone is used to form a desired image in the above white latent image area. Finally, heat is applied to the desired area of the thermal color-developing paper to develop a color all over that area. It is here to be noted that transfer of an ink image of a desired hue may follow the development of a color from the thermal color-developing paper. These operations are all feasible with one printer.

(3) A thermal transfer sheet including a hot-melt ink layer comprising a decoloring agent and a coloring agent is placed on thermal color-developing paper that develops a color different from that of the coloring agent. Then, heat is applied to the back side of the thermal transfer sheet to transfer the ink layer to the paper, so that the paper can develop a color at the same time as, or before or after, transfer of the ink layer.

In this method, too, a similar thermal transfer printer is used. A decoloring agent is incorporated in the ink layer of an ordinary thermal transfer sheet or a decoloring agent layer is formed on the ink layer of the thermal transfer sheet so that the decoloring agent and ink layer can be transferred to the thermal color-developing paper at the same time, whereby an image is formed by the ink layer while the thermal color-developing paper is prevented from color development. When a decoloring agent less compatible with the binder of the hot-melt ink layer is used as the decoloring agent, it diffuses itself over a narrow area of the thermal color-developing paper that is located in the vicinity of the transferred ink image, at which the thermal color-developing paper is prevented from color development. In addition, when a chromatic dye well compatible with the diffusing decoloring agent has been mixed with the ink layer or a chromatic decoloring agent is used, a colored rimmed area is obtained so that the obtained rimmed image can be well visible. It is here to be noted that the thermal color-developing paper may develop a color all over the area before or after, or at the same time as, the above image is formed.

The decoloring agent used herein is a reagent that functions to prevent leuco and other dyes contained in thermal color-developing paper from color development due to thermally imparted protons or make the colors produced by the leuco and other dyes invisible. Although varying depending on the type of thermal color-developing agent used, it is generally preferable to use thermoplastic polyether, polyethylene and polypropylene glycols and their deriviatives, alcohols such as stearyl alcohol, plasticizers such as dicyclohexyl phthalate, diethylhexyl phthalate and di(2-ethylhexyl)adipate, supercoolants such as polycaprolactone, polyester, acetamide, stearoamide, organic ammonium salts, organic amine, urea/thiourea and their derivatives, thiazoles, pyrroles, pyrimidines, piperazines, guanidines, indoles, imidazoles, imidazolines, triazoles, morpholines, piperidines, amidines, formamidines, pyridines, and olefin waxes, all being known decoloring agents and referred to by way of example alone. The decoloring agent mentioned above has preferably a melting point of 40° C. to 100° C. A thermal transfer sheet obtained by use of a decoloring agent that is liquid at normal temperature is poor in storage stability, while a thermal transfer sheet obtained by use of a decoloring agent having a melting point higher than 100° C. fails to obtain sufficient printability and decoloring effects with ordinary printing energy. However, even a decoloring agent that is liquid at normal temperature, if encapsulated with a polymeric material having a suitable melting point, may be used as the decoloring agent in the present invention. In order that the decoloring agent is used as an ink layer material, it is preferable to have a melting viscosity of up to 1,500 cps at 100° C. With material having a melting viscosity exceeding 1,500 cps at 100° C., it is impossible to obtain sufficient decoloring effects, because the infiltration of the decoloring agent into thermal color-developing paper drops upon thermal transfer printing.

Among the decoloring agents mentioned above, compounds having an ether bond in their molecule are particularly effective for preventing the color development of thermal color-developing paper or decoloring such paper. For instance, mention is made of polyethylene glycol or its derivative, polypropylene glycol or its derivative, polyglycerin or its derivative, aliphatic ethers, aromatic ethers, and cyclic ethers.

Among these, polyethylene glycol and its derivative, and polypropylene glycol and its derivative are particularly preferred. In view of the melting point, melting viscosity, solidifying characteristics and other factors needed for decoloring agents, the above compounds should have a weight-average molecular weight of up to 7,000, preferably 1,000 to 5,000. A compound having a weight-average molecular weight less than 1,000 is unpreferable for decoloring purposes, because it is liquid and so must be encapsulated for use. A compound having a weight-average molecular weight higher than 7,000 is again unpreferable for decoloring purposes because, as is the case with melting viscosity, the infiltration of the decoloring agent into thermal color-developing paper becomes low, failing to provide sufficient decoloring effects.

In general, polyethylene glycol shows a high affinity for water; in some cases, a problem arises in terms of the storability of the obtained thermal transfer sheet when it is stored under high humidity conditions. In such cases, it is preferable to use polyethylene glycol with at least one of the terminal hydroxyl groups thereof being etherified or esterified with an alcohol, an organic acid, or a monomer, oligomer or polymer containing a carboxyl group. This ensures that the obtained thermal transfer sheet is improved in terms of storage stability. Another possible approach to improving storability in surroundings is to incorporate fillers in the ink layer or layers. For the fillers incorporated into the ink layers, both organic and inorganic fillers may be used without restriction. However, preference is given to using organic fillers exemplified by ethylene-vinyl acetate copolymers, polyethylene, ionomer and polystyrene, and inorganic fillers represented by titanium oxide, calcium carbonate, silica and kaolin. To impart cushioning effects to the thermal transfer sheet, it is preferable that filler particle size is larger than ink layer thickness, and is specifically in the range of about 1 $\mu$m to about 10 $\mu$m.

In ink preparation, about 10 parts by weight to about 500 parts by weight of these decoloring agents may be mixed with 100 parts by weight of the wax, resin or other binder. In the alternative, they may be incorporated on the surface of the ink layer in an amount of at least 0.5 g/m$^2$.

In carrying out thermal transfer with a thermal head as mentioned above, the thermal energy and printing pressure applied to the thermal head may be about 0.2 mJ/dot and about 2 kg/line (with the line width being A4 width) that have often been used for conventional line type head printing. Even with such energy and pressure, it is possible to achieve sufficient effects on decoloring thermal color-developing paper. To enhance the decoloring effects, however, it is desired that the energy and pressure be about 0.4 mJ/dot and about 4 kg/line, respectively. It is preferable that both thermal transfer and thermal color development occur under basically identical conditions. In some cases, however, the printing pressure and applied energy may be varied.

The thermal transfer sheet of the present invention mentioned above and conventional thermal color-developing paper may be used either separately or in a combined form wherein the ink layer surface of the sheet is tentatively bonded to the color-developing surface of the paper. They may also be used in a ribbon form accommodating to the mechanism of the printing machine used. The ribbon form of thermal transfer sheet may be provided with a lead tape or end mark as well.

Other Aspects

The recording method proposed herein is characterized in that, to a system wherein a basic dye A and an acidic developer B form on a receiving sheet a color-development structure represented by an A-B bond through a chemical reaction, etc., a component C compatible with either one of said A and B but incompatible with the other is externally added, whereby said color-development structure is cleaved or otherwise the A-B bond is hindered to make said color-development structure invisible or allow the second color to be reproduced without color mixing.

This component C may be added to the above system through thermal transfer.

The above color-development principle is expressed by: Basic Dye A+Acidic Developer B=Color-Development Structure (A—B)

The above color-development reaction is reversible, and the above color-development structure is readily cleaved. Cleavage occurs by heat, light, etc., but it is preferable to cleave the color-development structure by addition of the component C that is compatible with either one of A and B but incompatible with the other. The component C may be added in droplet form to the color-development structure for cleavage. In a preferable embodiment, however, it is preferable that the component C has been contained in the thermal transfer sheet. Then, heat energy is applied from a thermal head to the thermal transfer sheet to make the component C compatible with either one of A and B, thereby cleaving the color-development structure or otherwise hindering the A-B bond. To keep the cleaved or hindered state in a stable manner, the component C used should preferably be not readily volatile and solid at normal temperature. For this component C use may be made of the decoloring agents referred to hereinbefore. However, it is preferable to use polyethylene glycol or its derivative that has a molecular weight of 1,000 to 7,000, a melting point of 50° C. to 70° C. and a solidifying point of 30° C. to 65° C. By making a thermal transfer layer containing component C chromatic, it is possible to achieve multicolor printing recording. In this case, it is preferable that coloring materials such as pigments and dyes are added to the thermal transfer layer containing component C.

The present invention will now be explained more illustratively with reference to examples and comparative examples where, unless otherwise state, parts and % are given by weight.

EXAMPLE A1

A 6.0-$\mu$m thick polyethylene terephthalate film having a slip layer on the back side and a mat layer of the following composition on the front side was used as the substrate film. The following ink composition was coated on the mat layer at a basis weight of 3 g/m$^2$ to form an ink layer. In this way, a thermal transfer sheet according to the present invention was obtained.

| Composition for the Mat Layer | |
|---|---|
| Carbon black | 24 parts |
| Polyester resin | 16 parts |
| Dispersant | 1.5 parts |
| Curing agent | 3 parts |
| **Ink Composition** | |
| Red pigment (Lake Red C) | 10 parts |
| Carnauba wax | 40 parts |
| Aliphatic amine | 50 parts |

EXAMPLE A2

Following Example A1, the following ink composition was coated on the mat layer at a basis weight of 3 g/m$^2$ to form an ink layer, on which the following mat ink layer was then coated at a basis weight of 1 g/m$^2$ to form a decoloring agent layer, thereby obtaining a thermal transfer sheet according to the present invention.

| Ink Composition | |
|---|---|
| Blue pigment (Phthalocyanine Blue) | 10 parts |
| Paraffin wax | 40 parts |
| Carnauba wax | 30 parts |
| Ethylene-vinyl acetate copolymer | 20 parts |
| **Mat Ink Composition** | |
| Dicyclohexyl phthalate | 50 parts |
| Carnauba wax | 50 parts |

EXAMPLE A3

Following Example A1, the following ink composition was coated on the mat layer at a basis weight of 3 g/m$^2$ to form an ink layer, on which the following mat ink layer was then coated at a basis weight of 1 g/m$^2$ to form a decoloring agent layer, thereby obtaining a thermal transfer sheet according to the present invention.

| Ink Composition | |
|---|---|
| Black pigment (carbon black) | 17 parts |
| Ethylene-vinyl acetate copolymer | 10 parts |
| Paraffin wax | 50 parts |
| Carnauba wax | 24 parts |
| **Mat Ink Composition** | |
| Polyethylene glycol (with a molecular weight of 4,000) | 100 parts |

EXAMPLE A4

A thermal transfer sheet according to the present invention was obtained following Example A1 with the exception that polypropylene glycol (with a molecular weight of 6,000) was used in place of the aliphatic amine.

COMPARATIVE EXAMPLE A1

Following Example A1, the following ink composition was coated on the mat layer at a basis weight of 3 g/m$^2$ to form an ink layer, thereby obtaining a thermal transfer sheet for comparative purposes.

| Ink Composition | |
|---|---|
| Green pigment (Phthalocyanine Green) | 10 parts |
| Carnauba wax | 30 parts |
| Paraffin wax | 40 parts |
| Ethylene-vinyl acetate copolymer | 20 parts |

APPLICATION EXAMPLE A1

Each of the thermal transfer sheets of Examples A1–4 & Comparative Example A1 was placed on the left half of the following thermal color-developing paper for printing at a fixed printing speed of 9 msec/line, using a thermal head operating at an applied energy of 0.4 mJ/dot and a printing pressure of 4 kg/line. After the completion of printing, the thermal transfer sheet was released to observe the printed image. The results are reported in Table A1.

Thermal Color-Developing Paper (1) Blackish purple thermal color-developing paper (Dye: Crystal Violet Lactone, and Developer: 4,4'-(isopropylidene)diphenyl)

(2) Red thermal color-developing paper (Dye: 3-diethylamino-5-methyl-7-chlorofluoran, and Developer: 4,4'-(isopropylidene)diphenol)

TABLE A1

| | Printed color tone | | | |
|---|---|---|---|---|
| | thermal | ink-printed color tone | | color tone |
| thermal transfer sheet | color-developing paper | pre-developed | non-developed area | printed by color development |
| Example A1 (red) | blackish purple | clear red | clear red | blackish purple |
| Example A2 (blue) | red | clear blue | clear blue | red |
| Example A3 (black) | red | clear black | clear black | red |
| Example A4 (red) | blackish purple | clear red | clear red | red |
| Comparative Example A1 (green) | blackish purple | unclear black tinged with blue | slightly unclear black tinged with blue | blackish purple |
| Application Example A1 (green) | red | unclear black tinged with purple | slightly unclear black tinged with purple | red |

EXAMPLE A5

A 4.5-$\mu$m thick polyethylene terephthalate film having a slip) layer on the back side and the mat layer of Example A1 on the front side was used as the substrate film. The following ink composition was coated on the mat layer at a basis weight of 3 g/M$^2$ to form an ink layer, thereby obtaining a thermal transfer sheet according to the present invention. This thermal transfer sheet was used with the thermal color-developing paper (1) of Application Example A1 for printing at an applied energy of 0.4 mJ/dot and a printing pressure of 4 kg/line. The results are reported in Table A2.

| Ink Composition | |
|---|---|
| Red pigment (Lake Red C) | 20 parts |
| Polyethylene glycol (with a molecular weight of 4,000) | 80 parts |

EXAMPLE A6

The following ink composition was used following Example A5 to obtain a thermal transfer sheet according to the present invention, which was then subjected to printing testing as in Example A5.

| Ink Composition | |
|---|---|
| Red pigment (Lake Red C) | 20 parts |
| Polyethylene glycol (with a molecular weight of 4,000) | 50 parts |
| Ethylene-acrylic acid copolymer | 30 parts |

EXAMPLE A7

A 4.5-$\mu$m thick polyethylene terephthalate film having a slip layer on the back side and a release layer on the front side was used as the substrate film. Then, an ink layer of the following composition was coated on the release layer at a thickness of 3 g/cm$^2$ to obtain a thermal transfer sheet according to the present invention, which was subjected to printing testing as in Example A5.

| Ink Composition | |
|---|---|
| Red pigment (Lake Red C) | 20 parts |
| Polyethylene glycol-polypropylene glycol copolymer (with a molecular weight of 10,000) | 80 parts |

EXAMPLE A8

A 4.5-$\mu$m thick polyethylene terephthalate film having a slip layer on the back side and a release layer on the front. side was used as the substrate film. An intermediate layer of the following composition was coated on the release layer at a basis weight of 2 g/cm$^2$. An ink composition of the following composition was coated on the intermediate layer at a basis weight of 3 g/m$^2$ to form an ink Layer, thereby obtaining a thermal transfer sheet according to the present invention, which was then subjected to printing testing as in Example A5.

| Composition for the Second Ink Layer | |
|---|---|
| Ethylene-vinyl acetate copolymer | 100 parts |
| **Composition for the First Ink Layer** | |
| Red pigment (Lake Red C) | 20 parts |
| Polyethylene glycol (with a molecular weight of 4,000) | 80 parts |

EXAMPLE A9

A 6.0-$\mu$m thick polyethylene terephthalate film having a slip layer on the back side and a release layer on the front side was used as the substrate film. A second ink layer of the following composition was coated on the release layer at a thickness of 2 g/cm$^2$. An ink composition of the following composition was coated on the intermediate layer at a thickness of 3 g/m$^2$, thereby obtaining a thermal transfer sheet according to the present invention, which was then subjected to printing testing as in Example A5.

| Composition for the Second Ink Layer | |
|---|---|
| Red pigment (Lake Red C) | 20 parts |
| Ethylene-vinyl acetate copolymer | 80 parts |
| **Composition for the First Ink Layer** | |
| Polyethylene glycol (with a molecular weight of 6,000) | 100 parts |

EXAMPLE A10

By coating the following ink composition pursuant to Example A5, an ink layer was formed to obtain a thermal transfer sheet according to the present invention, which was then subjected to printing testing as in Example A5.

| Ink Composition | |
|---|---|
| Blue pigment (Phthalocyanine Blue) | 20 parts |
| Thermally fusible encapsulated polyethylene glycol (with a molecular weight of 600) | 50 parts |
| Styrene-butadiene rubber | 30 parts |

EXAMPLE A11

An ink layer was formed following Example A10 with the exception that thermally fusible encapsulated polypropylene glycol having a molecular weight of 400 was used in place of the decoloring agent, thereby obtaining a thermal transfer sheet according to the present invention, which was then subjected to printing testing as in Example A5.

EXAMPLE A12

Using the thermal transfer sheet of Example A5, printing was done at an applied energy of 0.2 mJ/dot and a printing pressure of 2 kg/line. The results are reported in Table A2 to be given later.

EXAMPLE A13

Using the thermal transfer sheet of Example A6, printing was done at an applied energy of 0.2 mJ/dot and a printing pressure of 2 kg/line. The results are reported in Table A2 to be given later.

EXAMPLE A14

By coating the following ink composition pursuant to Example A5, an ink layer was formed to obtain a thermal transfer sheet according to the present invention, which was then subjected to printing testing as in Example A5.

| Ink Composition | |
|---|---|
| Red pigment (Lake Red C) | 20 parts |
| Polyethylene glycol distearate (with a molecular weight of 6,000) | 50 parts |
| Ethylene-acrylic acid copolymer | 30 parts |

EXAMPLE A15

By coating the following ink composition pursuant to Example A5, an ink layer was formed to obtain a thermal transfer sheet according to the present invention, which was then subjected to printing testing as in Example A5.

| Ink Composition | |
|---|---|
| Red pigment (Lake Red C) | 20 parts |
| Polyethylene glycol (with a molecular weight of 11,000) | 80 parts |

EXAMPLE A16

By coating the following ink composition pursuant to Example A5, an ink layer was formed to obtain a thermal transfer sheet according to the present invention, which was then subjected to printing testing as in Example A5.

| Ink Composition | |
|---|---|
| Red pigment (Lake Red C) | 20 parts |
| Polyethylene glycol (with a molecular weight of 4,000 | 70 parts |
| Ethylene-acrylic acid copolymer | 10 parts |

EXAMPLE A17

By coating the following ink composition pursuant to Example A5, an ink layer was formed to obtain a thermal transfer sheet according to the present invention, which was then subjected to printing testing as in Example A5.

| Ink Composition | |
|---|---|
| Red pigment (Lake Red C) | 20 parts |
| Polyglycerin stearate ester | 50 parts |
| Ethylene-acrylic acid copolymer | 30 parts |

EXAMPLE A18

By coating the following ink composition pursuant to Example A5, an ink layer was formed to obtain a thermal transfer sheet according to the present invention, which was then subjected to printing testing as in Example A5.

| Ink Composition | |
|---|---|
| Polyethylene glycol 4000 (reagent) | 30 parts |
| Ethylene-acrylic acid copolymer | 25 parts |
| Filler (ethylene-vinyl acetate copolymer particles of 6 $\mu$m in size; 30,000/mm$^2$) | 30 parts |
| Red pigment (Lake Red C) | 15 parts |

EXAMPLE A19

By coating the following ink composition pursuant to Example A5, an ink layer was formed to obtain a thermal transfer sheet according to the present invention, which was then subjected to printing testing as in Example A5.

| Ink Composition | |
|---|---|
| Polyethylene glycol 4000 (reagent) | 50 parts |
| Ethylene-acrylic acid copolymer | 33 parts |
| Filler (silica particles of 6 $\mu$m in size; 1,500/mm$^2$) | 2 parts |
| Red pigment (Lake Red C) | 15 parts |

EXAMPLE A20

By coating the following ink composition pursuant to Example A5, an ink layer was formed to obtain a thermal transfer sheet according to the present invention, which was then subjected to printing testing as in Example A5.

| Ink Composition | |
|---|---|
| Polyethylene glycol 4000 (reagent) | 30 parts |
| Ethylene-acrylic acid copolymer | 5 parts |
| Filler (ethylene-vinyl acetate copolymer particles of 4 $\mu$m in size; 150,000/mm$^2$) | 50 parts |
| Red pigment (Lake Red C) | 15 parts |

EXAMPLE A21

By coating the following ink composition pursuant to Example A5, an ink layer was formed to obtain a thermal transfer sheet according to the present invention, which was then subjected to printing testing as in Example A5.

| Ink Composition | |
|---|---|
| Polyethylene glycol 4000 (reagent) | 50 parts |
| Ethylene-acrylic acid copolymer | 34.5 parts |
| Filler (silica particles of 5.5 $\mu$m in size; 300/mm$^2$) | 0.5 parts |
| Red pigment (Lake Red C) | 15 parts |

EXAMPLE A22

By coating the following ink composition pursuant to Example A5, an ink layer was formed to obtain a thermal transfer sheet according to the present invention, which was then subjected to printing testing as in Example A5.

| Ink Composition | |
|---|---|
| Polyethylene glycol 4000 (reagent) | 30 parts |
| Ethylene-acrylic acid copolymer | 35 parts |
| Filler (ethylene-vinyl acetate copolymer particles of 1 $\mu$m in size; 25,000/mm$^2$) | 10 parts |
| Red pigment (Lake Red C) | 15 parts |

EXAMPLE A23

By coating the following ink composition pursuant to Example A5, an ink layer was formed to obtain a thermal transfer sheet according to the present invention, which was .hen subjected to printing testing as in Example A5.

| Ink Composition | |
|---|---|
| Polyethylene glycol 4000 (reagent) | 50 parts |
| Ethylene-acrylic acid copolymer | 25 parts |
| Filler (ethylene-vinyl acetate copolymer particles of 6 $\mu$m in size; 20,000/mm$^2$) | 10 parts |
| Red pigment (Lake Red C) | 15 parts |

EXAMPLE A24

A thermal transfer sheet according to the present invention was obtained following Example A8 with the exception that the composition for the second ink layer referred to in Example A8 was changed to the following composition for the second ink layer, and was then subjected to printing testing as in Example A5.

| Composition for the Second Ink Layer | |
|---|---|
| Ethylene-vinyl acetate copolymer | 80 parts |
| Polyethylene glycol (with a molecular weight of 4,000) | 20 parts |

EXAMPLE A25

By coating the following ink composition pursuant to Example A5, an ink layer was formed to obtain a thermal transfer sheet according to the present invention, which was then subjected to printing testing as in Example A5.

| Ink Composition | |
|---|---|
| Red pigment (Lake Red C) | 20 parts |
| Polyoxyethylene-bisphenol A ester | 50 parts |
| Ethylene-acrylic acid copolymer | 30 parts |

EXAMPLE A26

An ethylene-vinyl acetate copolymer was coated on the ink layer of the thermal transfer sheet of Example A6 at a basis weight of 0.5 g/m$^2$ to form a protective layer thereon, thereby obtaining a thermal transfer sheet according to the present invention, which was then subjected to printing testing as in Example A5.

EXAMPLE A27

A thermal transfer sheet according to the present invention was obtained following Example A26 with the exception that the composition for the protective layer of Example A26 was changed to the following composition, and was then subjected to printing testing as in Example A5.

| Composition for the Protective Layer | |
|---|---|
| Ethylene-acrylic acid copolymer | 40 parts |
| Filler (ethylene-vinyl acetate copolymer particles of 6 $\mu$m in size) | 60 parts |

COMPARATIVE EXAMPLE A2

By coating the following ink composition as in Example A5, the thermal transfer sheet of Comparative Example A1 was obtained, and then subjected to printing testing as in Example A12.

| Ink Composition | |
|---|---|
| Red pigment (Lake Red C) | 20 parts |
| Carnauba wax | 80 parts |

TABLE A2

| thermal transfer sheet | color mixing *1 | transfer-ability *2 | weaken-ing | viscosity of decolor-ing agent (cps) | melting point of decolor-ing agent (° C.) | storage stability |
|---|---|---|---|---|---|---|
| Example A5 | ◎ | ○ | ○ | 83 | 60.6 | ○ |
| Example A6 | ◎ | ◎ | ◎ | 83 | 60.6 | ○ |
| Example A7 | ○ | ○ | ○ | 500 | 56.6 | ○ |
| Example A8 | ◎ | ◎ | ○ | 83 | 60.6 | ○ |
| Example A9 | ◎ | ◎ | ○ | 980 | 64.4 | ○ |
| Example A10 | ◎ | ◎ | ○ | 10 | — | ◎ |
| Example A11 | ◎ | ◎ | ○ | 12 | — | ◎ |
| Example A12 | ○ | ◎ | ◎ | 83 | 60.6 | ○ |
| Example A13 | ○ | ◎ | ◎ | 83 | 60.6 | ○ |
| Example A14 | ◎ | ◎ | ◎ | 870 | 56.2 | ◎ |
| Example A15 | Δ | ○ | ○ | 1600 | 65.8 | ○ |
| Example A16 | ◎ | ○ | ◎ | 83 | 64.4 | ○ |
| Example A17 | Δ | ○ | ○ | 500 | 59.5 | ◎ |
| Example A18 | ◎ | ◎ | ◎ | 83 | 60.6 | ◎ |
| Example A19 | ◎ | ◎ | ◎ | 83 | 60.6 | ◎ |
| Example A20 | ○ | ○ | ◎ | 83 | 60.6 | ◎ |
| Example A21 | ◎ | ◎ | ◎ | 83 | 60.6 | ○ |
| Example A22 | ◎ | ◎ | ◎ | 83 | 60.6 | ○ |
| Example A23 | ◎ | ◎ | ◎ | 83 | 60.6 | ◎ |
| Example A24 | ◎ | ◎ | ◎ | 83 | 60.6 | Δ |

TABLE A2-continued

| thermal transfer sheet | color mixing *1 | transfer-ability *2 | weaken-ing | viscosity of decolor-ing agent (cps) | melting point of decolor-ing agent (° C.) | storage stability |
|---|---|---|---|---|---|---|
| Example A25 | Δ | Δ | ◎ | 127 | 108 | ◎ |
| Example A26 | ◎ | ◎ | ◎ | 83 | 60.6 | ◎ |
| Example A27 | ◎ | ◎ | ◎ | 83 | 60.6 | ◎ |
| Comparative Example A2 | X | ◎ | ◎ | — | — | ◎ |

*1 Evaluation was made on the following criteria: The cross mark shows that the substrate film is visible with some color mixing observed. The triangle mark shows that the substrate film is not completely invisible with some color mixing observed. The circle mark shows that the substrate film is almost invisible with little color mixing. The double circle mark shows that no color mixing is observed at all.
*2 Evaluation was made on the following criteria: The double circle mark shows that no weakening is observed at all. The circle mark shows that some noticeable, if not serious, weakening is observed.
*3 Evaluation was made on the following criteria: The double circle mark shows that the boundary between the image and non-image areas is clear. The circle mark shows that the boundary between the image and non-image areas is somewhat vague albeit being not serious.
*4 Viscosity at 100° C.
*5 Evaluation was made after a 3-day storage at 40° C. and a humidity of 80%. The double circle mark shows that no migration of the ink layer component into the back side is observed at all. The circle mark shows that a slight degree of migration of the ink layer component to the back side is observed.

APPLICATION EXAMPLE A2

The thermal transfer sheet prepared in Example A18 was slit, and provided with a lead tape and an end mark, and was then loaded in an ink ribbon cassette for word processors. The obtained ink ribbon-containing cassette was mounted on a word processor for printing on the areas of the thermal color-developing paper used in Application Example A1 that did and did not develop a color. Consequently, a clear two-color printed matter was obtained.

APPLICATION EXAMPLE A3

The thermal transfer sheet prepared in Example A18 was cut to size A1, and was then placed on thermal color-developing paper for printing on a large printer. Consequently, a clear two-color printed matter was obtained. It is thus found that two-color printing can be done more expensively than would be possible with thermal transfer printing alone.

According to the present invention explained with reference to the foregoing examples, when the ink layer is printed on thermal color-developing paper, the decoloring agent contained in the ink layer prevents the color development of the thermal color-developing paper due to printing heat, or otherwise mat such paper. Consequently, there is no hue change of the ink layer. By use of such mechanism, it is also possible to make printing smooth because there is no need of changing the printing conditions for the thermal head in transfer of the ink layer and allowing the thermal color-developing paper to develop a color by itself.

The thermal transfer sheet and method according to the present invention are effective for feeding image signals to a larger printer, thereby making printed matters having magnified images. For instance, they have particular application in making color images of large size for posters and banners.

EXAMPLE B1

The following ink compositions were sand-milled and mixed together at a ratio of 1:1:3, and the mixture was coated on the surface of wood free paper at a solid basis weight of 10 g/m$^2$ to obtain thermal color-developing paper 1.

| | |
|---|---|
| **Ink A** | |
| 2-anilino-3-methyl-6-diethylaminofluoran (black development) | 10 parts |
| 5% aqueous solution of methyl cellulose | 5 parts |
| Water | 25 parts |
| **Ink B** | |
| Bisphenol A | 15 parts |
| 5% aqueous solution of methyl cellulose | 5 parts |
| Water | 25 parts |
| **Ink C** | |
| 2-phenoxynaphthalene | 10 parts |
| Calcium carbonate | 15 parts |
| 5% aqueous solution of polyvinyl alcohol | 5 parts |
| Water | 15 parts |

The thus obtained thermal color-developing paper 1 was solid-printed for black development.

The following ink compositions were formed on a 4.5-μm thick polyethylene terephthalate film to form thereon a back layer, a mat layer and a decoloring agent layer, thereby obtaining a mat thermal transfer sheet 1.

| | |
|---|---|
| Ink for the Back Layer (at a solid coating weight of 0.3 g/m$^2$) | |
| Silicone-modified acrylic resin | 10 parts |
| Toluene | 90 parts |
| Ink for the Mat Layer (at a solid coating weight of 0.4 g/m$^2$) | |
| Polyester resin | 20 parts |
| Carbon black | 10 parts |
| Toluene/methyl ethyl ketone (1/1) | 70 parts |
| Ink for the Matting Agent Layer (at a solid coating weight of 0.1 g/m$^2$) | |
| Polyethylene glycol diester (with a molecular weight of 4,000) | 20 parts |
| Methanol | 80 parts |

Using the above mat thermal transfer sheet, the area of the thermal color-developing paper solid-printed in black was printed to form a mat area including rimmed and logos regions, as shown in FIG. 3.

Then, a thermal transfer sheet was similarly obtained with the exception that the following hot-melt ink composition at a basis weight of 2 g/m$^2$ was used in place of the mat ink of the ink layer of the mat thermal transfer sheet mentioned above. This transfer sheet was used to print logos "DNP" as shown in FIG. 3 in the above rimmed area, thereby obtaining such a rimmed image as shown in FIG. 3.

| Ink Composition | |
|---|---|
| Blue pigment (Phthalocyanine Blue) | 10 parts |
| Carnauba wax | 30 parts |
| Paraffin wax | 40 parts |
| Ethylene-vinyl acetate copolymer | 20 parts |

EXAMPLE B2

The following ink composition were sand-milled and mixed together at a ratio of 1:1:3, and the mixture was coated on the surface of wood free paper at a solid basis weight of 10 g/m$^2$ to obtain thermal color-developing paper 2. However, the anchor and overcoat layers were applied at coating weights of 1 g/m$^2$ and 0.5 g/m$^2$, respectively.

| | |
|---|---|
| **Ink A** | |
| Crystal Violet Lactone (blue development) | 10 parts |
| 5% aqueous solution of methyl cellulose | 5 parts |
| Water | 25 parts |
| **Ink B** | |
| Bisphenol A | 15 parts |
| 5% aqueous solution of methyl cellulose | 5 parts |
| Water | 25 parts |
| **Ink C** | |
| 2-phenoxynaphthalene | 10 parts |
| Calcium carbonate | 15 parts |
| 10% aqueous solution of polyvinyl alcohol | 5 parts |
| **Anchor Layer 1** | |
| SBR latex | 15 parts |
| 10% aqueous solution of polyvinyl alcohol | 30 parts |
| Water | 100 parts |
| **Overcoat Layer 1** | |
| Aluminum hydroxide | 15 parts |
| Polyvinyl alcohol (a 10% aqueous solution) | 70 parts |
| Polyamide resin | 5 parts |
| Water | 100 parts |

Following Example B1, the thus obtained thermal color-developing paper 2 was solid-printed for blue development.

The following ink compositions were coated on a 6.0-$\mu$m thick polyethylene terephthalate film to form thereon a back layer and a decoloring agent layer, thereby obtaining a mat thermal transfer sheet 2.

| Ink for the Back Layer (at a solid coating weight of 0.2 g/m$^2$) | |
|---|---|
| Silicone-modified acrylic resin | 10 parts |
| Polyisocyanate | 0.05 parts |
| Toluene/methyl ethyl ketone (1/1) | 90 parts |
| (For curing a 24-hour aging was done at 50° C.) | |
| **Ink for the Matting Agent Layer (at a solid coating weight of 2.0 g/m$^2$)** | |
| Dicyclohexyl phthalate | 30 parts |
| Carnauba wax | 70 parts |

Using the above mat thermal transfer sheet, the area of the thermal color-developing paper solid-printed in blue was printed to form a mat area including rimmed and logos regions, as shown in FIG. 3.

Then, a thermal transfer sheet was similarly obtained with the exception that the following hot-melt ink composition at a basis weight of 2 g/m$^2$ was used in place of the mat ink of the ink layer of the mat thermal transfer sheet mentioned above. This transfer sheet was used to print logos "DNP" as shown in FIG. 3 in the above rimmed area, thereby obtaining such a rimmed image as shown in FIG. 3.

| Ink Composition | |
|---|---|
| Lake Red (pigment-dispersed emulsion) | 10 parts |
| SBR latex | 30 parts |
| Paraffin wax emulsion | 40 parts |
| Carnauba wax emulsion | 20 parts |
| Isopropyl alcohol/water | 50 parts |

EXAMPLE B3

The following ink compositions were sand-milled and mixed together at a ratio of 1:1:3, and the mixture was coated on the surface of wood free paper at a solid basis weight of 10 g/m$^2$ to obtain thermal color-developing paper 3.

| | |
|---|---|
| **Ink A** | |
| 3-dimethylamino-7-chlorofluoran (red development) | 10 parts |
| 5% aqueous solution of methyl cellulose | 5 parts |
| Water | 25 parts |
| **Ink B** | |
| Bisphenol A | 15 parts |
| 5% aqueous solution of methyl cellulose | 5 parts |
| Water | 25 parts |
| **Ink C** | |
| 2-phenoxynapthalene | 10 parts |
| Calcium carbonate | 15 parts |
| 10% aqueous solution of polyvinyl alcohol | 5 parts |
| Water | 20 parts |

Following Example B1, the thus obtained thermal color-developing paper 3 was solid-printed for black development.

A thermal transfer sheet was similarly obtained with the exception that the following hot-melt ink composition at a basis weight of 2 g/m$^2$ was used in place of the mat ink of the ink layer of the mat thermal transfer sheet 1 used in Example B1. This transfer sheet was used to print logos "DNP" as shown in FIG. 3, thereby obtaining such a rimmed image as shown in FIG. 3.

| Ink Composition | |
|---|---|
| Water dispersion of carbon black | 10 parts |
| Polyethylene glycol (with a molecular weight of 4,000) | 50 parts |
| Dispersion of ethylene-vinyl acetate copolymer fine particles | 30 parts |
| Ethylene-acrylic acid copolymer | 10 parts |
| Methanol/water (2/1) | 20 parts |

COMPARATIVE EXAMPLE B1

Pursuant to Example B1, the following hot-melt ink composition was coated at a basis weight of 3 g/m$^2$ to form an ink layer, thereby obtaining a thermal transfer sheet for comparative purposes. This transfer sheet was used for printing on the above color-developing paper 3 as in Example B3.

| Ink Composition | |
|---|---|
| Phthalocyanine Blue | 10 parts |
| Carnauba wax | 20 parts |
| Ethylene-vinyl acetate copolymer | 15 parts |
| Microcrystalline wax | 55 parts |

COMPARATIVE EXAMPLE B2

Pursuant to Example B1, the following hot-melt ink composition was coated at a basis weight of 3 g/m$^2$ to form an ink layer, thereby obtaining a thermal transfer sheet for comparative purposes. This transfer sheet was used for printing on the above color-developing paper 3 as in Example B3.

| Ink Composition | |
|---|---|
| Carbon black | 15 parts |
| Carnauba wax | 20 parts |
| Ethylene-vinyl acetate copolymer | 20 parts |
| Paraffin wax | 40 parts |

TABLE B1

| | Color printed by thermal transfer | | | |
|---|---|---|---|---|
| | color-developing paper | printing on the developed area of color-developing paper | printing on the non-developed area of color-developing paper | rimming |
| Example B1 | black | blue | blue | rimmed |
| Example B2 | blue | red | red | rimmed |
| Example B3 | red | black | black | rimmed |
| Comparative Example B1 | black | dark blue + black | dark blue | not-rimmed |
| Comparative Example B2 | red | black | black | not-rimmed |

According to the present invention explained with reference to the foregoing examples, when the decoloring agent-containing hot-melt ink layer is printed on thermal color-developing paper, the decoloring agent present in or on the ink layer prevents the thermal color-developing paper from color development due to printing heat or makes the color, once developed thereby, invisible. Even when thermal transfer printing is made on the area of the paper that has been printed by colordeveloping, the decoloring agent makes the color-developed area invisible. When a decoloring agent less compatible with the binder of the hot-melt ink layer is used as the decoloring agent, it diffuses itself over an area of the paper that is located in the vicinity of the transferred ink image, at which the thermal color-developing paper is prevented from color development (or otherwise makes the color, once developed, invisible). Consequently, the white or colored edge of the ink image defines a rimmed area. Thus, a narrow white or colored area is defined between the color-developed and ink image areas on the thermal color-developing paper, so imparting greatly aesthetic or eye-catching appearance to the resulting image.

EXAMPLE C1

A thermal color-developing paper (black development) comprising a leuco dye and bisphenol A was printed with a thermal head to obtain a printed matter. Desired logos were drawn on the thus obtained printed matter using a semi-solid form of polyethylene glycol (PEG-2000), thereby obtaining a printed matter with white logos printed thereon.

EXAMPLE C2

An ink layer was transferred from a thermal transfer sheet having the following transfer ink composition coated thereon to thermal color-developing paper (black development) containing a leuco dye and bisphenol A, thereby making white logos.

| Transfer Ink Composition (at a basis weight of 3.0 g/m$^2$) | |
|---|---|
| PEG-4000 | 30 parts by weight |
| MeOH | 70 parts by weight |

EXAMPLE C3

An ink layer was transferred from a thermal transfer sheet having the following ink coated thereon to thermal color-developing paper (black development) containing a leuco dye and bisphenol A, thereby recording thereon a multicolor image.

| Transfer Ink Composition (at a basis weight of 3.0 g/m$^2$) | |
|---|---|
| Red pigment | 5 parts by weight |
| PEG-4000 | 30 parts by weight |
| Water dispersion of carnauba wax | 20 parts by weight |
| Methanol/water = 1/1 | 45 parts by weight |

What is claimed is:

1. A rimmed image formed on a thermal color-developing paper, the rimmed image being formed by solid-heating at least an area of the thermal color-developing paper to form a color-developed area, and applying a decoloring agent ink to the color-developed area to form a white image, and forming in the white image area an image that is similar in shape to, and smaller in size than, said white image area to obtain the rimmed image.

2. A rimmed image as claimed in claim 1, wherein the image is a thermally transferred image.

3. A rimmed image as claimed in claim 1, wherein the hue of the color-developed area is different from that of the image.

4. A method for forming a rimmed image by solid-heating at least an area of thermal color-developing paper for color development, applying decoloring agent ink to said area to form a white image, and forming in said white image area an image that is similar in shape to, and smaller in size than, said white image area.

5. A method for forming a rimmed image by applying decoloring agent ink to at least an area of thermal color-developing paper to form a white latent image, forming in said area a colored image that is similar in shape to, and smaller in size than, said area, and solid-heating a region of the thermal color-developing paper including said area.

6. A method for forming a rimmed image as claimed in claim 5, wherein said decoloring agent ink is a compound having an ether bond.

7. method for forming a rimmed image as claimed in claim 5, wherein said decoloring agent ink is polyethylene glycol or polypropylene glycol or their derivative.

8. A thermal transfer sheet including on one surface of a substrate film a first thermally transferable ink layer comprising a decoloring agent for at least one of (1) preventing color development of thermal color-developing paper and (2) making already developed color invisible, and at least one second thermally transferable ink layer interposed between said first ink layer and said substrate film, said second thermally transferable ink layer comprising a decoloring agent for at least one of (1) preventing color development of thermal color-developing paper and (2) making already developed color on color developing paper invisible.

* * * * *